US007018185B2

(12) United States Patent
Makino et al.

(10) Patent No.: US 7,018,185 B2
(45) Date of Patent: Mar. 28, 2006

(54) LIQUID RECOVERY METHOD AND SYSTEM FOR COMPRESSION MECHANISM

(75) Inventors: Masahiko Makino, Shiga (JP); Minoru Kajitani, Kusatsu (JP); Nobuaki Ogawa, Otsu (JP); Yoshifumi Abe, Ritto (JP); Yukihiro Fujiwara, Kusatsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 310 days.

(21) Appl. No.: 10/727,668

(22) Filed: Dec. 5, 2003

(65) Prior Publication Data

US 2004/0107847 A1 Jun. 10, 2004

(30) Foreign Application Priority Data

Dec. 6, 2002 (JP) ..... 2002-355229

(51) Int. Cl.
*F03C 2/00* (2006.01)
*F04C 18/00* (2006.01)

(52) U.S. Cl. ..... 418/94; 418/97; 418/55.4; 418/270; 417/410.5; 417/371; 184/6.17; 184/6.18

(58) Field of Classification Search ..... 418/55.1–55.6, 418/94, 97, 270, DIG. 1; 184/6.17, 6.18; 417/371, 410.5
See application file for complete search history.

(56) References Cited

U.S. PATENT DOCUMENTS

| | | | | |
|---|---|---|---|---|
| 5,007,809 | A * | 4/1991 | Kimura et al. | 417/371 |
| 5,533,875 | A * | 7/1996 | Crum et al. | 418/94 |
| 5,591,018 | A * | 1/1997 | Takeuchi et al. | 418/94 |
| 5,645,408 | A * | 7/1997 | Fujio et al. | 418/94 |
| 5,772,411 | A * | 6/1998 | Crum et al. | 418/55.1 |
| 6,000,917 | A * | 12/1999 | Smerud et al. | 417/368 |
| 6,045,344 | A * | 4/2000 | Tsuboi et al. | 418/DIG. 1 |
| 6,544,009 | B1 | 4/2003 | Makino et al. | |
| 6,827,563 | B1 * | 12/2004 | Hiwata et al. | 418/55.6 |
| 2003/0002999 | A1 | 1/2003 | Sakurabayashi et al. | |
| 2003/0013343 | A1 | 1/2003 | Abe et al. | |

FOREIGN PATENT DOCUMENTS

| | | |
|---|---|---|
| JP | 7-151083 | 6/1995 |
| JP | 11-082352 | 3/1999 |
| JP | 2000-291557 | 10/2000 |
| JP | 2001-020865 | 1/2001 |
| JP | 2001020881 A * | 1/2001 |
| JP | 2001-280552 | 10/2001 |
| JP | 2002-070743 | 3/2002 |
| JP | 2002-115686 | 4/2002 |
| JP | 2002-174178 | 6/2002 |
| JP | 2002-180984 | 6/2002 |

(Continued)

OTHER PUBLICATIONS

Enlish Language Abstract JP No.7-151803.

(Continued)

*Primary Examiner*—Theresa Trieu
(74) *Attorney, Agent, or Firm*—Greenblum & Bernstein, P.L.C.

(57) ABSTRACT

Lubricating liquid fed from a reservoir to a compression mechanism is collected by a circumferential wall that surrounds the drive shaft of the compression mechanism and rotates synchronously with it immediately after liquid is discharged into the space inside the housing with or without compressed fluid. Liquid is then urged outward under centrifugal force from an outlet formed at a preset axial location of the circumferential wall. Exiting liquid is received by a fixed liquid return cover that surrounds the circumferential wall near its outlet and led back to the reservoir.

11 Claims, 6 Drawing Sheets

FOREIGN PATENT DOCUMENTS

| | | |
|---|---|---|
| JP | 2002-188574 | 7/2002 |
| JP | 2002-285981 | 10/2002 |

OTHER PUBLICATIONS

Enlish Language Abstract JP No.11-082352.
Enlish Language Abstract JP No. 2000-291557.
Enlish Language Abstract JP No. 2001-020865.
Enlish Language Abstract JP No. 2001-280552.
Enlish Language Abstract JP No. 2002-070743.
Enlish Language Abstract JP No. 2002-115686.
Enlish Language Abstract JP No. 2002-174178.
Enlish Language Abstract JP No. 2002-180984.
Enlish Language Abstract JP No. 2002-188574.
Enlish Language Abstract JP No. 2002-285981.

* cited by examiner

LIQUID RECOVERY METHOD AND SYSTEM FOR COMPRESSION MECHANISM

The present disclosure relates to subject matter contained in priority Japanese Patent Application No. 2002-355229, filed on Dec. 6, 2002, the contents of which is herein expressly incorporated by reference in its entirety.

BACKGROUND OF THE INVENTION

1. Field of the Invention

The present invention relates to a liquid recovery method and system for a compressor that encases inside a housing a compression mechanism and a reservoir for holding liquid used to lubricate sliding parts including the compression mechanism.

2. Description of the Related Art

The compressor of this kind is made air-tight by connecting a housing to a refrigeration cycle. Driving the compression mechanism introduces refrigerant from the cycle into the housing from a suction port, compresses and discharges the refrigerant into the space inside the housing, and returns the refrigerant back to the cycle from a discharge port. Lubricating oil in a reservoir inside the housing is supplied to sliding parts including the compression mechanism either alone or mixed in the refrigerant to provide lubrication. The compressor is thus basically maintenance-free. Generally, the refrigerant discharged from the compression mechanism back to the refrigeration cycle contains lubricating oil, which can be the cause of various problems in the cycle. A compressor with a lubrication system in which lubricating oil flows out into the refrigeration cycle in a large amount tends to be bulky because it necessitates a large oil reservoir to prevent insufficient lubrication of sliding parts.

Some known lubricant recovery systems use techniques (so called "cyclone system") of centrifugally separating lubricating oil from to-be-discharged refrigerant before it flows out into the refrigeration cycle, so as to return the oil to the reservoir inside the housing (for example, see Japanese Patent Laid-Open Publication Nos. Hei 7-151083 (patent document 1), Hei 11-82352 (patent document 2), 2001-20865 (patent document 3), 2001-280552 (patent document 4), 2002-115686 (patent document 5)). Typically, a cylindrical centrifugal separator is arranged orthogonally to the axial line of the compressor, into which refrigerant discharged from the compression mechanism is introduced from an upper part along a tangential line, so as to create a downward whirl along the cylindrical surface. Refrigerant flows upward from the bottom of the separator through a central portion and returns to the refrigeration cycle, while the lubricating oil that is separated from the refrigerant under centrifugal force is drained from a lower part of the separator to return to the reservoir in the housing.

Patent document 2 shows a system in which centrifugally separated lubricating oil is blown out parallel to the oil surface of the reservoir so as not to disturb the oil surface, whereby the oil level in the reservoir is maintained constant and the supply of oil to the sliding parts made stable, and also, any backflow of lubricating oil in the reservoir because of the disturbed oil surface is prevented.

Patent documents 3 to 5 show compressors in which an annular dividing wall is provided between the compression mechanism and the stator of the electric motor that drives the mechanism. More particularly, the dividing wall disclosed in the patent document 3 includes partitions that divide the annular space between the dividing wall and housing into left and right chambers for flowing-in refrigerant and flowing-out refrigerant, respectively. This structure creates a smooth flow of refrigerant discharged from the compression mechanism, from the flowing-in refrigerant chamber into the housing through the electric motor towards the reservoir in the lower part, where it turns upward and flows out of the housing through the flowing-out refrigerant chamber. The in-coming refrigerant hits against the stator of the electric motor and makes a sharp turn, whereby lubricating oil is separated efficiently by centrifugal force.

Patent documents 4 and 5 show structures in which refrigerant discharged from the compression mechanism is led toward inside of the dividing wall. The refrigerant is then guided downward in a swirl through the rotor of the electric motor together with lubricating oil used for lubricating the bearing, which forms another sliding parts in the compression mechanism around the drive shaft. The lubricating oil is centrifugally separated from refrigerant as the refrigerant hits against the inner face of the stator or when it travels downward from the bottom of the rotor, so that refrigerant is discharged to the outside of the housing after lubricating oil has been removed.

Meanwhile, demands for lighter vehicles equipped with such air conditioner compressors are increasing to address growing energy and environmental issues. The down-weighting is particularly crucial for electric vehicles or gasoline-electric hybrid vehicles, whose drive power obtained from batteries is not as high as that of gasoline vehicles. The vehicle-mounted electric compressor that includes a large and heavy electric motor should obviously be as small and light as possible.

The inventors of the present application have endeavored to achieve downsizing and down-weighting of compressor by downsizing of compression mechanism and electric motor inside the housing and by reduction of dead space inside the housing, and in these research and development the inventors have encountered the problem of insufficient lubrication in sliding parts such as the compression mechanism.

Through various tests and investigations the inventors found that the insufficient lubrication was caused by a delay in the replenishment of lubricating oil: While the reservoir holds less amount of oil because of the downsizing of the housing, recovery of the oil that has been supplied to sliding parts is not made quickly enough, even with the oil separation systems shown in the above-mentioned patent documents 3 to 5.

Other systems in the art include those shown in the patent documents 1 and 2, in which oil that has lubricated sliding parts is all discharged with refrigerant through the compression mechanism and is separated and recovered. With such systems, the problem of insufficient lubrication will not occur if oil separation is made efficiently. To ensure sufficient oil separation, however, the system needs to be complex and bulky, contrary to the demands for downsizing and down-weighting. Further, this system does not provide lubrication to sliding parts other than the compression mechanism.

In the system shown in the patent document 3, the refrigerant that flows into the housing from the compression mechanism toward the electric motor does not contact lubricating oil that is discharged after lubricating the bearing, which forms sliding parts other than the compression mechanism around the drive shaft, because of the dividing wall. Any oil entrained in the refrigerant is separated and returned to the reservoir. Although the oil is not collected immediately after the refrigerant is discharged, the amount of oil carried in the refrigerant is small and it is efficiently recovered. However, the amount of lubricating oil that is used for lubricating the bearing is much larger than the oil entrained in the refrigerant, and it takes time to recover this oil; because it drops onto the rotor of the electric motor and is scattered around by the rotor or balance weight, it travels downwards only when it is urged onto the dividing wall or inner face of the stator by centrifugal force, and is collected in the reservoir when it drops from the bottom of the stator. Thus this portion of lubricating oil can cause insufficient lubrication.

In the systems shown in the patent documents 4 and 5, the refrigerant that flows into the housing from the compression mechanism toward the electric motor is led inside of the dividing wall and blown into the inside of the stator, towards the reservoir. The refrigerant carries with it the lubricating oil that has lubricated the bearing, which is centrifugally separated by the rotation of the rotor or balance weight. Oil is thus collected somewhat quicker than the system shown in the patent document 3 but still has to travel long. Further, an attempt to increase the recovery speed will cause more oil to pass through the rotor without being separated from the refrigerant, resulting in a lower recovery rate. Thus there is still scope of improvement in respect of prevention of insufficient lubrication.

Furthermore, none of the oil separation systems shown in the patent documents 3 to 5 is applicable to horizontal compressors.

SUMMARY OF THE INVENTION

An object of the present invention is to provide a liquid recovery method and system for a compression mechanism, with which liquid used for lubricating sliding parts inside the housing of a compressor including the compression mechanism is quickly returned to a reservoir without hindering the use of compressed gas flowing inside the housing.

To achieve the above object, the present invention provides a liquid recovery method for a compressor including a compression mechanism, a housing for containing the compression mechanism, and a reservoir at a lower part of the housing for holding liquid, for recovering the liquid that has been supplied to lubricate sliding parts of the compression mechanism back into the reservoir, characterized in that the liquid that is supplied from the reservoir to the compression mechanism is collected immediately after being discharged into the housing with or without compressed fluid by a circumferential wall that rotates around a drive shaft of the compression mechanism in synchronism therewith so that liquid is urged outward from the wall through an outlet formed at a predetermined axial location of the wall under centrifugal force, which liquid is received by a liquid return cover fixed around the outlet of the circumferential wall to be returned to the reservoir.

Liquid discharged into the housing is immediately collected by collision against a surrounding liquid collection member that has a circumferential wall and an outlet at a certain axial location and rotates with the drive shaft of the compression mechanism, so that it is not scattered inside the housing or deposited on other parts inside the housing. Collected liquid travels along the circumferential wall and spreads while being pressed against the circumferential wall because of the centrifugal force generated by the rotating liquid collection member, whether it be entrained in the compressed fluid or not. The liquid is thrown out under centrifugal force as it reaches the outlet of the spinning circumferential wall. This liquid exiting from the predetermined axial location is received by the liquid return cover fixed around the outlet and led into the reservoir. Liquid is thus collected in a confined area immediately after it is discharged into the housing and recovered quickly through a short path without a detour or scatter. This system works in any of vertical, horizontal, or tilted compressors.

The above method is implemented by a liquid recovery system that includes a liquid collection member consisting of a circumferential wall that surrounds an area into which liquid is discharged from the compression mechanism with or without compressed fluid and rotates around the drive shaft directly or indirectly with it and an outlet at a preset axial location of the wall for collecting discharged liquid and throwing it out through the outlet under centrifugal force, and a liquid return cover fixed to surround the outlet of the circumferential wall for receiving the exiting liquid and guiding it back into the reservoir.

According to another aspect of the invention, there is provided a liquid recovery method for a compressor including a compression mechanism, a housing for containing the compression mechanism, and a reservoir at a lower part of the housing for holding liquid, for recovering the liquid that has been supplied to lubricate sliding parts of the compression mechanism back into the reservoir, characterized in that liquid that is supplied from the reservoir to the compression mechanism is collected immediately after being discharged into the housing through sliding parts that are arranged around a drive shaft and do not contribute to the compression by a circumferential wall that rotates around the drive shaft of the compression mechanism in synchronism therewith so that liquid is urged outward from the wall through an outlet formed at a predetermined axial location of the wall under centrifugal force, which liquid is received by a liquid return cover fixed around the outlet of the circumferential wall to be returned to the reservoir.

A portion of liquid supplied from the reservoir to the compression mechanism is discharged alone into the housing through sliding parts that are located around the drive shaft but do not contribute to the compression, and this portion of liquid is immediately collected when it hits against the surrounding wall of the liquid collection member that has an outlet at a certain axial location and rotates with the drive shaft, so that it is not scattered inside the housing or deposited on other parts inside the housing. Collected liquid travels along the circumferential wall and spreads while being pressed against the circumferential wall because of the centrifugal force generated by the rotating liquid collection member, whether there be an air current created by compressed fluid or not. Liquid is then thrown out under centrifugal force as it reaches the outlet of the spinning circumferential wall. This liquid exiting from the predetermined axial location is received by the liquid return cover fixed around the outlet and led into the reservoir. Liquid is thus collected in a confined area immediately after it is discharged into the housing and recovered quickly through a short path without a detour or scatter, without hindering the functions of the compressed fluid that cools the electric motor and lubricates sliding parts other than the compression mechanism with the liquid carried thereby. This system works in any of vertical, horizontal, or tilted compressors.

The above method is implemented by a liquid recovery system that includes a liquid collection member consisting of a circumferential wall that surrounds an area into which liquid is discharged from the compression mechanism through sliding parts that are located around the drive shaft but do not contribute to the compression, the circumferential wall being rotated around the drive shaft directly or indirectly with it, and an outlet at a preset axial location of the wall for collecting discharged liquid and throwing it out through the outlet under centrifugal force, and a liquid return cover surrounding the outlet of the circumferential wall for receiving the exiting liquid and guiding it back into the reservoir.

According to yet another aspect of the invention, there is provided a liquid recovery system for a compressor including a compression mechanism, an electric motor for driving the compression mechanism, a housing for containing the compression mechanism and the electric motor, and a reservoir at a lower part of the housing for holding liquid, for recovering the liquid that has been supplied to lubricate sliding parts of the compression mechanism back into the reservoir, characterized in that the system includes a liquid collection member having a circumferential wall that surrounds an area between the compression mechanism and the electric motor into which liquid is discharged through sliding parts that are located around a drive shaft but do not contribute to the compression, the circumferential wall being rotated around the drive shaft directly or indirectly with the shaft, and an outlet at a preset axial location of the wall for collecting discharged liquid and throwing it out through the outlet under centrifugal force, and a liquid return cover surrounding the outlet of the circumferential wall for receiving the exiting liquid and guiding it back into the reservoir.

Part of liquid supplied from the reservoir to the compression mechanism is discharged separately from compressed fluid between the compression mechanism and electric motor through sliding parts that are located around the drive shaft but do not contribute to the compression, and this liquid is immediately collected when it hits against the surrounding wall of the liquid collection member that has an outlet at a certain axial location and rotates with the drive shaft, so that liquid is not scattered inside the housing or deposited on the electric motor or other parts inside the housing. Collected liquid travels along the circumferential wall and spreads while being pressed against the circumferential wall, because of the centrifugal force generated by the rotating liquid collection member, whether it be entrained in the compressed fluid or not. Liquid is then thrown out under centrifugal force as it reaches the outlet of the spinning circumferential wall. This liquid exiting from the predetermined axial location is received by the liquid return cover fixed around the outlet and led into the reservoir. Liquid is thus collected in a confined area immediately after it is discharged into the housing and recovered quickly through a short path, without hindering the functions of the compressed fluid that cools the electric motor and lubricates sliding parts other than the compression mechanism with the liquid carried thereby. This system works in any of vertical, horizontal, or tilted compressors.

According to a further aspect of the invention, there is provided a liquid recovery system for a horizontally installed compressor including a compression mechanism, an electric motor for driving the compression mechanism, a housing for containing the compression mechanism and the electric motor, and a reservoir at a lower part of the housing for holding liquid, for recovering liquid that has been supplied to lubricate sliding parts of the compression mechanism back into the reservoir, characterized in that the system includes a liquid collection member having a circumferential wall that surrounds an area between the compression mechanism and the electric motor into which liquid is discharged through the sliding parts that are located around the drive shaft but do not contribute to the compression, the circumferential wall being rotated around the drive shaft directly or indirectly with the shaft, and an outlet at a preset axial location of the wall for collecting discharged liquid and throwing it out through the outlet under centrifugal force, and a liquid return cover surrounding the outlet of the circumferential wall for receiving the exiting liquid and guiding it back into the reservoir.

With this system, liquid is recovered even more quickly by a reduced distance from the liquid return cover to the reservoir at the bottom of the horizontally oriented housing. Moreover, because the liquid drains under gravity from the liquid return cover into the reservoir, it does not disturb the liquid surface in the reservoir.

An opening that the circumferential wall has at one end opposite the electric motor may be doubled as the outlet. Since the liquid is collectively thrown outward from the edge of the outlet at right angles to the axial line, it can be collected reliably by the axially short liquid return cover.

The circumferential wall may be spread outward along the axial direction toward the outlet side, so that the flow of collected liquid pressed against the circumferential wall under centrifugal force is controlled in the spreading direction, i.e., toward the outlet, for faster flow and efficient recovery of liquid.

The liquid return cover may be formed to include a lowermost portion from which to guide the liquid into the reservoir, so that collected liquid is drained under gravity into the lowermost portion and led smoothly into the reservoir.

Alternatively, the liquid return cover may be designed so that it guides liquid from the lowermost portion via a drain hole or path into the reservoir.

Other objects and features of the invention will become more apparent in the following detailed description and accompanying drawings. Each feature of the invention can be adopted either alone or in various possible combinations.

DETAILED DESCRIPTION OF THE PREFERRED EMBODIMENTS

Figure 1:
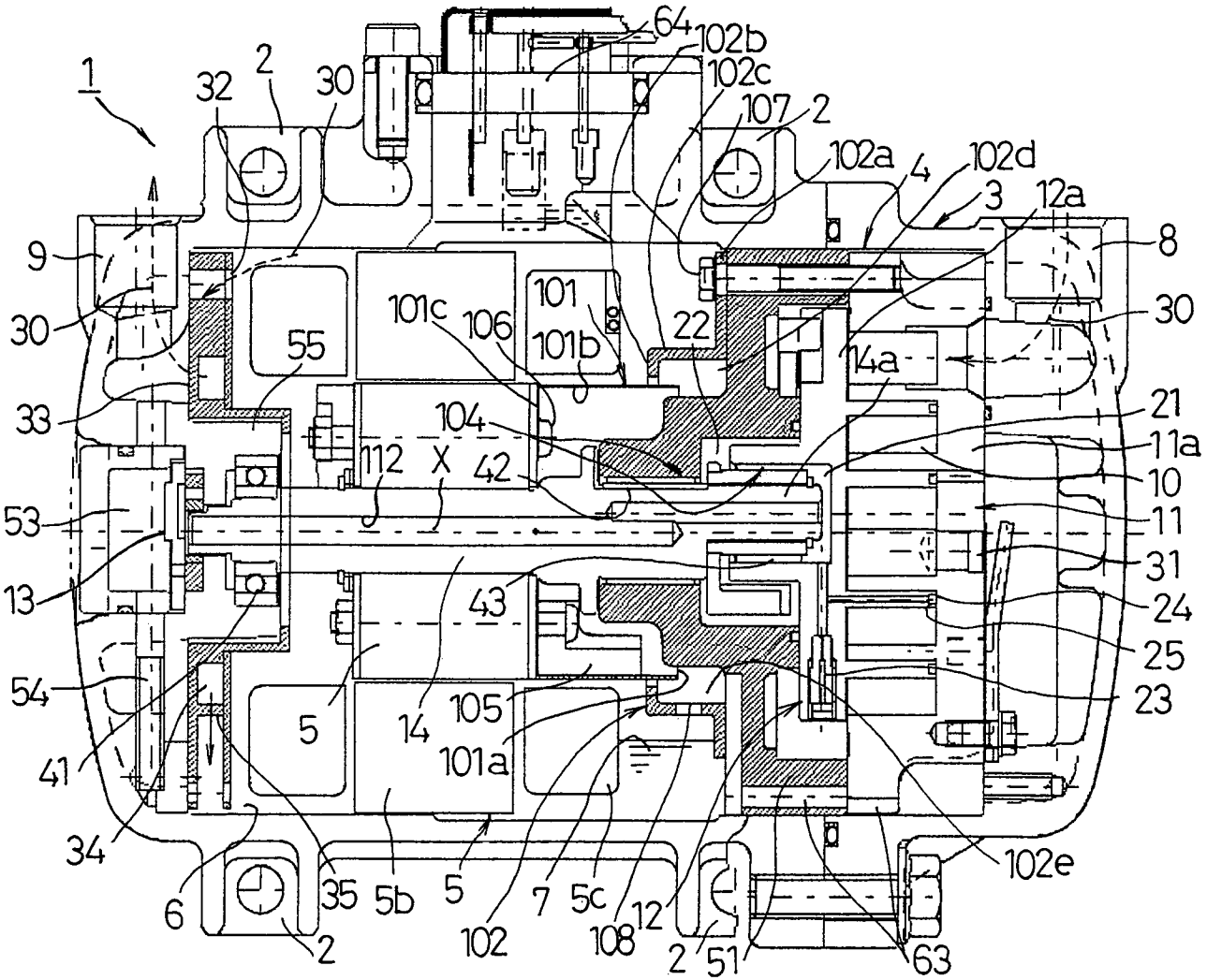
FIG. 1 is a cross-sectional view of one example of a compressor which adopts the liquid recovery method and system for the compression mechanism according to one embodiment of the invention.
Figure 2:
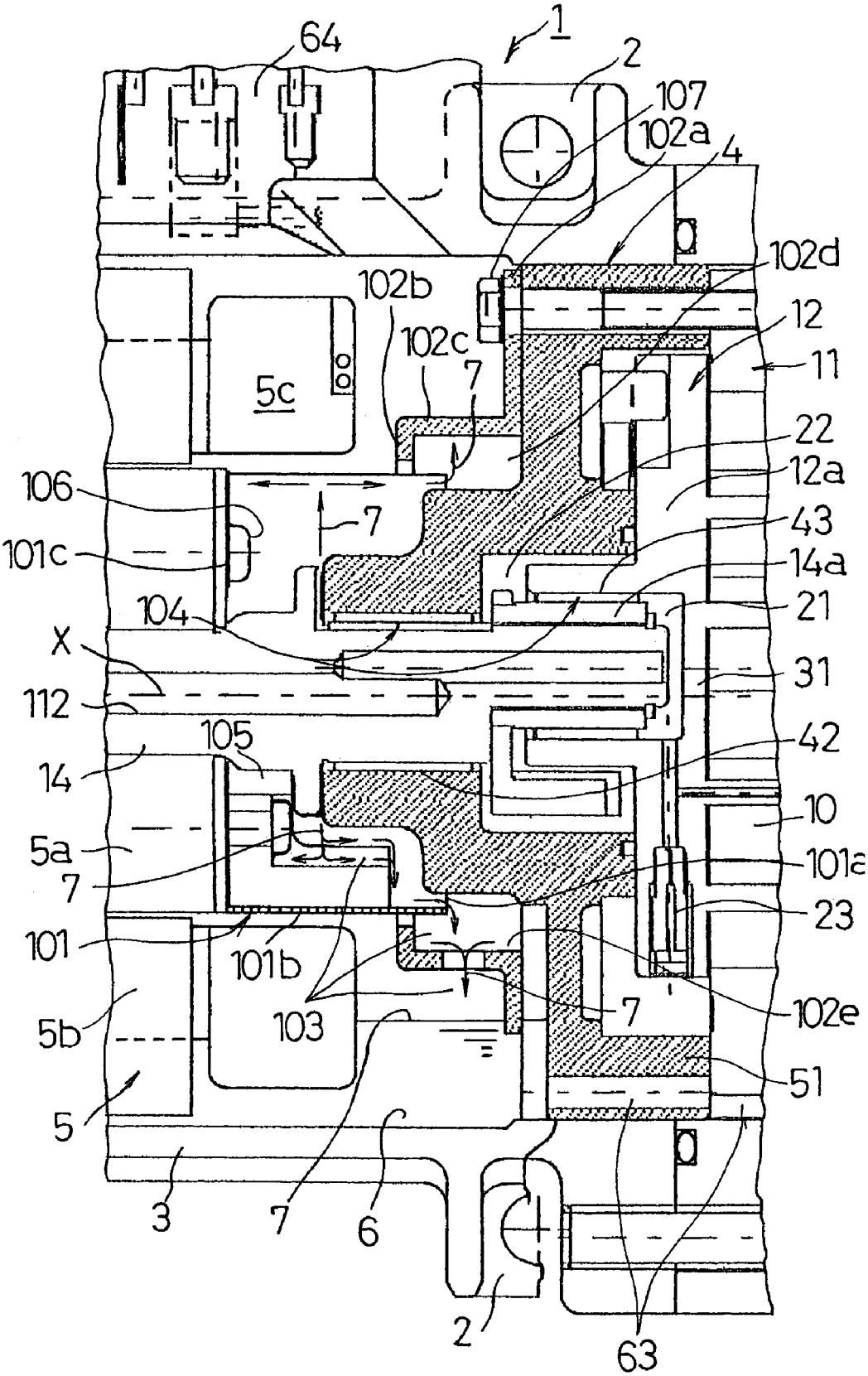
FIG. 2 is a cross-sectional view illustrating an essential part of the compressor of FIG. 1 in detail.

Compressors in preferred embodiments of the present invention will be hereinafter described in detail with reference to FIG. 1 to FIG. 6. FIG. 1 shows one example of a scroll compressor used for refrigeration applications. The compressor 1 is installed horizontally on mounting legs 2 under the body of the compressor 1 and includes a housing 3 containing a compression mechanism 4 and an electric motor 5 as its drive power source, and a reservoir 6 for holding liquid used to provide lubrication to various sliding parts including the compression mechanism 4. This compressor uses gas refrigerant as the compression fluid. The liquid in this example is lubricating oil 7 that is compatible with the refrigerant, and it is used not only for the lubrication of the sliding parts but also for providing a seal in the sliding parts of the compression mechanism 4. The invention is obviously not limited to the structure of this example and is basically applicable to any compressor that has a compression mechanism and a reservoir that holds lubricating liquid for sliding parts.

As seen from FIG. 1, the compression mechanism 4 of the compressor 1 includes a fixed scroll member 11 and an orbiting scroll member 12 with blades erecting from end plates 11*a*, 12*a* in an interleaved relationship to form a compression space 10, which moves and changes its volume as the orbiting scroll member 12 is driven by the electric motor 5 through a drive shaft 14 to orbit relative to the fixed scroll member 11, whereby suction, compression, and discharge of the refrigerant 30 supplied from an outer cycle are achieved as indicated by broken-line arrows through a suction port 8 and a discharge port 9 formed in the housing 3. In the example of FIG. 1, refrigerant is discharged from a discharge port 31 at one end of the compression mechanism 4 and housing 3 opposite the electric motor 5, and made to flow towards the electric motor 5 through a passage 63 inside the compression mechanism 4 or between the compression mechanism 4 and the housing 3, so as to cool the electric motor 5 and provide lubrication of a bearing 41 at one end of the drive shaft 14 opposite the compression mechanism 4 with the lubricating oil 7 carried by the refrigerant, which then reaches the discharge port 9 in the housing 3. The passage 63 is shown at the location in FIG. 1 only for convenience of illustration; it is normally formed somewhere near the reservoir 6 away from lubricating oil surface.

The lubricating oil 7 contained in the reservoir 6 is forced upward either by driving a displacement type pump 13 with the drive shaft 14 or by using differential pressure inside the housing 3 to travel through an oil passage 112 in the drive shaft 14 and fed to a lubricant pool 21 or 22 (21 in the illustrated example) at the backside of the rotating orbiting scroll member 12. The lubricating oil 7 fed there further travels to the backside of the outer periphery of the orbiting scroll member 12 with a throttle 23 or some other means of restriction to support the orbiting scroll member 12 from the backside, while at the same time being fed to a groove 25 that retains a tip seal 24 at the tip of the blade of the orbiting scroll member 12 for providing a seal between itself and the fixed scroll member 11, so that sealing and lubrication between the fixed and orbiting scroll members 11, 12 are both accomplished. In this embodiment, the lubricating oil 7 in the reservoir 6 is sucked up by the pump 13 through a suction passage 54 at the end wall of the housing 3 opposite from the compression mechanism 4 and supplied through a pump chamber 53 into the oil passage 112 for the lubrication purpose described above.

The compressor 1 of this embodiment adopts a method that enables collection of lubricating oil 7 in a confined area inside the housing 3 and quick recovery of the lubricating oil 7 to the reservoir 6 through a shortest possible path without any unnecessary detouring or scattering, immediately after the lubricating oil 7 has been discharged from the compression mechanism 4 alone or with the refrigerant 30 (alone in the illustrated example). The lubricating oil 7 immediately after being discharged from the compression mechanism 4 into the housing 3 with or without refrigerant 30 is first collected by a circumferential wall 101*b* that surrounds the drive shaft 14 and rotates synchronously with it. The lubricating oil 7 is then urged outward under the influence of centrifugal force from an outlet 101*a* formed at a preset location in the direction of the axial line X. Oil exiting from the outlet 101*a* is received by a fixed liquid return cover 102 that surrounds the circumferential wall 101*b* near its outlet 101*a* and led back to the reservoir.

The compressor 1 thus includes a liquid collection member 101 consisting of the circumferential wall 101*b* that rotates around the drive shaft 14 directly or indirectly with it and the outlet 101*a* at the preset axial location of the wall 101*b* for collecting oil 7 discharged from the compression mechanism 4 and urging it out through the outlet 101*a* under centrifugal force, and the fixed liquid return cover 102 surrounding the circumferential wall 101*b* near its outlet 101*a* for receiving the exiting oil 7 and guiding it back into the reservoir 6.

The lubricating oil 7, therefore, is immediately collected by the surrounding liquid collection member 101 or due to hit after it is discharged into the space inside the housing 3, whereby scattering and adhesion of the lubricating oil 7 on other parts inside the housing 3 are prevented.

Collected oil 7, whether it be alone or entrained in refrigerant 30, is pressed against the circumferential wall 101*b* and spreads on its own on the wall by centrifugal force created by the rotating liquid collection member 101. The circumferential wall 101*b* has a straight surface in the illustrated examples of FIG. 1 to FIG. 4 and the lubricating oil 7 travels both circumferentially and towards both ends as indicated by solid-line arrows in FIG. 2. A portion of the lubricating oil that has traveled towards the end of the outlet 101*a* is stopped there and guided into the outlet 101*a*. As the lubricating oil 7 reaches the outlet 101*a*, it is expelled outward by centrifugal force created by the rotating circumferential wall 101*b*, as indicated by the solid-line arrows in FIG. 2, FIG. 5, and FIG. 6. This lubricating oil 7 exiting from the predetermined axial location is reliably received by the fixed liquid return cover 102 surrounding the outlet 101*a* and returned to the reservoir 6.

The liquid collection member 101 thus enables collection of the oil 7 that is discharged into the housing 3 in a confined space and quick recovery of oil through a short path, for example, as denoted at 103 in the drawings. Therefore, even if the volume of the reservoir 6 is reduced because of downsizing of the compressor 1, oil shortage to the compression mechanism 4 is prevented because the lubricating oil 7 fed to the mechanism 4 is swiftly recovered to the reservoir 6 and replenished. The liquid recovery system can thus contribute to further reduction in size and weight of the compressor 1.

According to another aspect of the invention, a portion of lubricating oil 7 that has lubricated the bearing 104, which is one example of sliding parts that are arranged around the drive shaft 14 but do not contribute to the compression operation, is also collected by the circumferential wall 101*b* that surrounds the drive shaft 14 and rotates synchronously with it immediately after oil is discharged into the space inside the housing 3. The lubricating oil 7 is then urged outward under the influence of centrifugal force from the outlet 101*a* formed at the preset axial location of the wall 101*b*. The exiting oil 7 is received by the fixed liquid return cover 102 that surrounds the circumferential wall 101*b* near its outlet 101*a* and guided back to the reservoir 6.

The compressor 1 thus includes a liquid collection member 101 having the circumferential wall 101*b* that surrounds an area into which the lubricating oil 7 is discharged after lubricating the bearing 104 and rotates around the drive shaft 14 directly or indirectly with the shaft and the outlet 101*a* at the preset axial location of the wall 101*b* for collecting the discharged lubricating oil 7 and throwing it out through the outlet 101*a* under centrifugal force, and the liquid return cover 102 surrounding the outlet 101*a* of the circumferential wall 101*b* for receiving the exiting oil 7 and guiding it back into the reservoir 6.

A portion of the lubricating oil 7 is immediately collected by the surrounding liquid collection member 101 or due to hit after it is discharged into the space inside the housing 3 through the bearing 104 around the drive shaft 14, whereby scattering and adhesion of oil 7 on the electric motor 5 or other parts inside the housing 3 are prevented.

The liquid return cover 102 receives the collected oil 7 and guides it back into the reservoir 6 with reliability. The liquid collection member 101 thus enables collection of the portion of the lubricating oil 7 that is separately discharged from the bearing 41, which is one example of sliding parts that are arranged around the drive shaft 14 but do not contribute to the compression operation, in a confined space and quick recovery of oil through the short path 103.

The above portion of lubricating oil 7 is discharged separately from refrigerant in a relatively abundant amount, and because this portion of oil is quickly recovered, oil shortage due to size reduction of the compressor 1 is prevented. Also, this system does not inhibit refrigerant 30 expelled into the housing 3 from cooling the electric motor 5 and providing lubrication to the bearing 41, which forms another sliding parts other than the compression mechanism 4, with entrained lubricating oil 7.

According to yet another aspect of the invention, to install the electric motor 5 for driving the compression mechanism 4, the compressor 1 includes a liquid collection member 101 having the circumferential wall 101*b* that surrounds an area into which oil is discharged between the electric motor 5 and the compression mechanism 4 after lubricating the compression mechanism 4 and the bearing 104 and rotates around the drive shaft 14 directly or indirectly with the shaft and the outlet 101*a* at the preset axial location of the wall 101*b* for collecting the lubricating oil 7 and throwing it out through the outlet 101*a* under centrifugal force, and the liquid return cover 102 surrounding the outlet 101*a* of the circumferential wall 101*b* for receiving the exiting lubricating oil 7 and guiding it back into the reservoir 6.

The lubricating oil 7 is therefore immediately collected by the surrounding liquid collection member 101 or due to hit after it has lubricated the bearing 104 and is discharged separately from refrigerant into the area between the compression mechanism 4 and the electric motor 5, whereby scattering and adhesion of the lubricating oil 7 on the electric motor 5 or other parts inside the housing 3 are prevented.

The liquid return cover 102 receives the lubricating oil 7 thus collected and expelled from the outlet 101*a* and guides it back into the reservoir 6. The liquid collection member 101 thus enables immediate collection of the lubricating oil 7 exiting into the area between the compression mechanism 4 and the electric motor 5 in a confined space and quick recovery of oil through the short path 103.

With this system, the lubricating oil 7 that is discharged in a relatively abundant amount separately from refrigerant is prevented from adhering on the electric motor 5 that has a complex structure and is located in the immediate vicinity, and is quickly recovered. Also, this system does not inhibit refrigerant 30 from cooling the electric motor 5 and providing lubrication to the bearing 41, which forms another sliding parts other than the compression mechanism 4, with entrained lubricating oil 7.

The above system works irrespective of the design of the compressor, i.e., whether it be installed vertically or horizontally, or slanted, but would particularly be advantageous if adopted in a vertical compressor 1 shown in FIG. 6, because recovery of a portion of the lubricating oil 7 that has lubricated the bearing 104 tends to be hard to achieve in such a vertical compressor, as the oil that drops upon the electric motor 5 directly below the bearing 104 can easily be scattered by the rotating rotor 5*a* and deposited on various parts of the stator 5*b*.

If applied in horizontal compressors 1 shown in FIG. 1 to FIG. 4B, and FIG. 5, on the other hand, the arrangement of the liquid return cover 102 that is very close to the reservoir 6 located in a lower part of the housing 3 makes the recovery path 103 from the liquid collection member 101 through the cover 102 back to the reservoir 6 much shorter than the case in a vertical compressor 1, in which the reservoir (not shown) would be located at the bottom, whereby quick recovery of lubricating oil 7 is ensured.

The examples shown in FIG. 1 to FIG. 4B, FIG. 5, and FIG. 6 will be described in further detail below. The bearing 104 in the compression mechanism 4 of the compressor 1 shown in FIG. 1 to FIG. 4B is located inside the space formed by the coil end 5*c* of the electric motor's stator 5*b*, so that the housing 3 is much reduced in length in the direction of axial line X. The lubricating oil 7 discharged from the bearing 104 in such a horizontal compressor 1 will drop into the coil end 5*c* and may be scattered onto its inner periphery by the rotating drive shaft 14, and is particularly hard to recover. With the liquid collection member 101 and liquid return cover 102, however, the lubricating oil 7 that is discharged separately in relative abundance from the bearing 104 is collected and recovered before it is deposited on the electric motor 5. The liquid collection member 101 itself is located inside the space formed by the coil end 5*c* and takes up no extra room, so that it causes no increase in size of the compressor 1 or its housing 3. Moreover, the circumferential wall 101*b* of the liquid collection member 101 extends further than the space surrounded by the coil end 5*c* and forms the outlet 101*a*, so that the lubricating oil 7 is transferred toward and discharged from the outlet 101*a* outside the space, and quickly returned to the reservoir 6 by the liquid return cover 102. The liquid return cover 102 is located in the space that is formed around the bearing 104 between the compression mechanism 4 and coil end 5*c* which are in the closest vicinity, with the rotor balancer 105 between them; it takes up no extra space for recovering oil 7 expelled from the liquid collection member 101, and causes no increase in size of the compressor 1 or its housing 3.

Figure 3B:
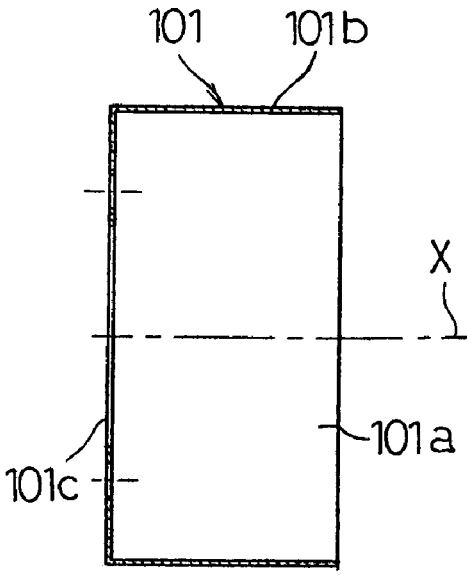
FIG. 3A is a front view and FIG. 3B is an axial cross section of a liquid collection member of the liquid recovery system of FIG. 1.
Figure 3A:
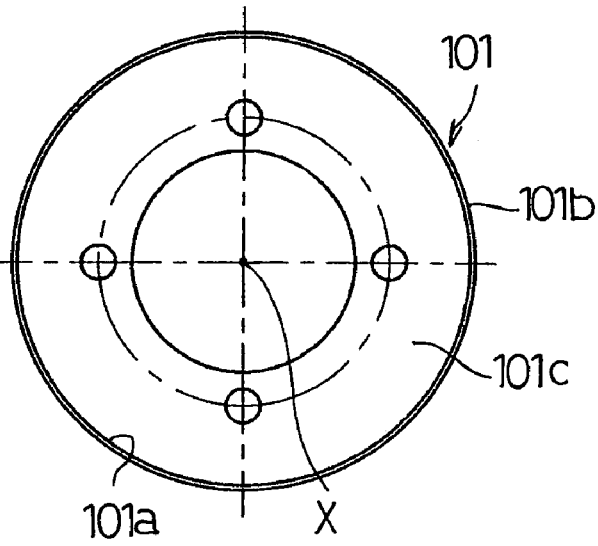
Figure 4A:
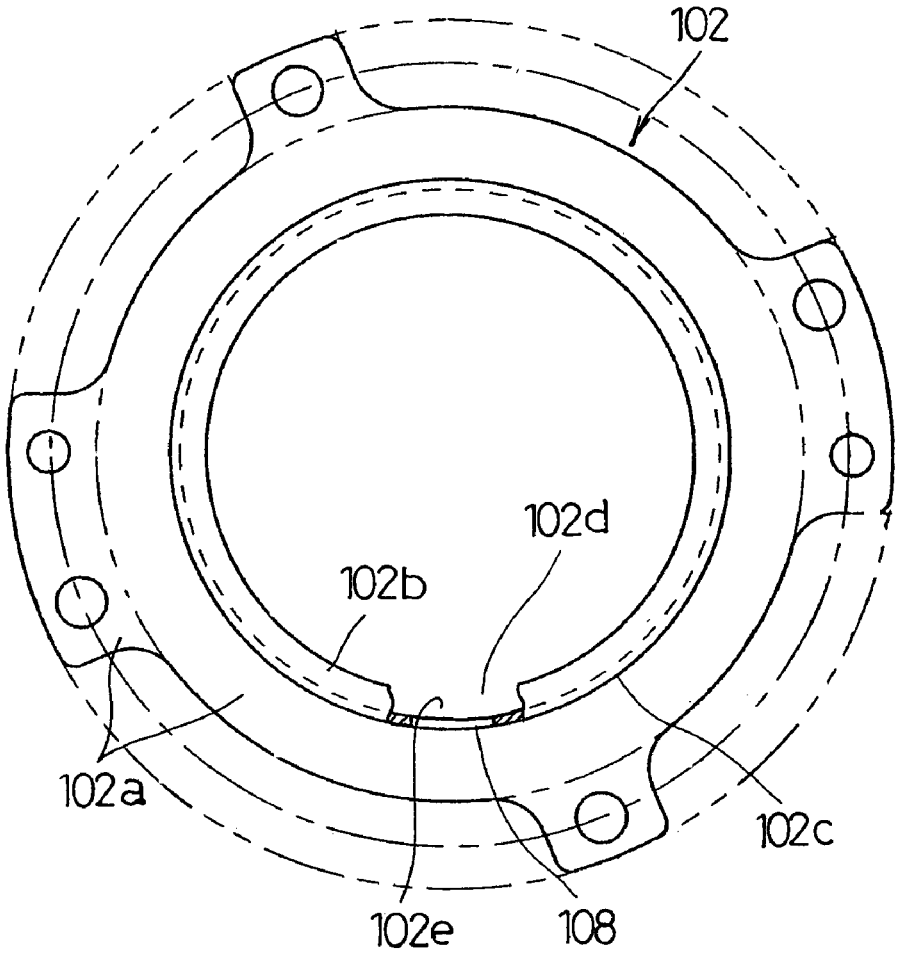
FIG. 4A is a front view and FIG. 4B is a transverse cross section of a liquid return cover of the liquid recovery system.
Figure 4B:
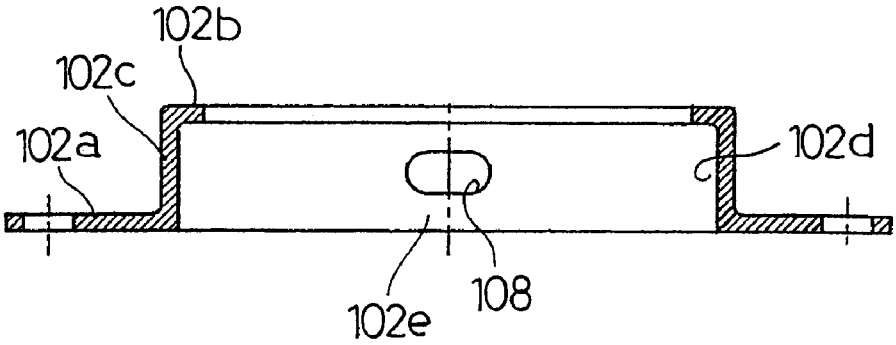

The liquid collection member 101 is located outside the rotor balancer 105 which is either an integral or separate part. That is, the oil collection area is provided inside the space that is necessary for the rotation of the drive shaft 14 and rotor balancer 105 of the rotor 5*a*, without taking up any extra room. In the illustrated example, a separate rotor balancer 105 and the cap-like metal liquid collection member 101 as shown in FIG. 3A and FIG. 3B covered on the rotor balancer 105 from the side of the rotor 5*a* are mounted to the end face of the rotor 5*a* using fastening bolts 106 of the rotor 5*a*. The space needed for the rotation of the rotor balancer 105 is formed inside the space surrounded by the coil end 105*c*. The liquid collection member 101 has an integrally formed bottom end wall 101*c* at the opposite end from the outlet 101*a*, which is used as the mounting portion. In a design where the liquid collection member 101 needs to be insulated from surrounding parts, it would have to be made of an insulating material such as resin. In this case, the liquid collection member 101 must be made of a material that does not deform or bulge outward under the influence of centrifugal force during the rotation with the drive shaft 14 and rotor 5*a*.

The inner face of the rotor balancer 105 also forms the surface for collecting and expelling oil 7 together with the inner face of the circumferential wall 101*b*. The rotor balancer 105 counterbalances the weight of the eccentric shaft 14*a* of the drive shaft 14 for causing the orbiting motion of the orbiting scroll member 12. The rotor balancer 105 may be attached to the drive shaft 14, in which case the liquid collection member 101 may also be mounted to the drive shaft 14 on the outside of the rotor balancer 105. Alternatively, the liquid collection member 101 may be mounted to the drive shaft 14 separately from the rotor balancer 105.

The liquid return cover 102 has a mounting washer 102*a* on its periphery, at which it is fixedly mounted to one face of a main bearing member 51 on the side of the electric motor 5 using bolts 107 for fastening the main bearing member 51 to the fixed scroll member 11 such as to surround the bearing 104. The main bearing member 51 retains the fixed scroll member 11 that has the discharge port 31 with the orbiting scroll member 12 interposed therebetween, and is fixed to the inner periphery of the housing 3 as by shrink fitting. From the inner periphery of the mounting washer 102*a* of the liquid return cover 102 is a cylindrical part 102*c* extending at right angles towards the electric motor 5, with an inward flange 102*b* at its end. The cover 102 further has an annular groove 102*d* between the cylindrical part 102*c* and the main bearing member 51, which annular groove surrounds the bearing 104 and the outlet 101*a* of the liquid collection member 101. Lubricating oil 7 exiting from the outlet 101*a* of the liquid collection member 101 is received by this groove 102*d*, and collected into a lowermost portion 102*e* so that it is guided smoothly down to the reservoir 6. For this purpose a drain hole 108 is provided in the lowermost portion 102*e* so that collected oil 7 is drained and returned to the reservoir 6. Alternatively, a return passage from the liquid return cover 102 to the reservoir 6 may be provided in the cover 102.

The bearing 104 of the main bearing member 51, for which the above described lubrication is provided, includes an eccentric bearing 43 for the orbiting motion, which leads to the lubricant pools 21, 22, and a main bearing 42 that supports the drive shaft 14 relative to a lateral portion of the compression mechanism 4. The bearing 41 at the other end mentioned in the foregoing is a so called sub bearing, and is retained in a bearing housing 55 integrally formed in the end wall of the housing 3 opposite from the compression mechanism 4. A power supply terminal 64 for the electric motor 5 is mounted to the body of the housing 3, so that the housing 3 has a shorter axial length than the case where such power supply terminal is provided at the axial end of the housing 3.

A refrigerant circulation passage 34 for causing refrigerant 30 discharged from the discharge port 31 of the compression mechanism 4 into the housing 3 to circulate around the axial line X of the compressor 1 is illustrated by way of example as being formed around the bearing housing 55. Refrigerant 30 is introduced from a refrigerant inlet 32 as indicated by the broken-line arrow in FIG. 1 and circulated around the axial line X of the compressor 1 including the drive shaft 14 and bearing housing 55, as guided by the refrigerant circulation passage 34, which has a curved shape with a predetermined radius of curvature that enables the lubricating oil 7 entrained in the refrigerant 30 to be separated therefrom by centrifugal force and/or by collision while the refrigerant 30 passes therethrough before it is expelled from a refrigerant return outlet 33 on the side of the discharge port 9 of the housing 3 to be recirculated. The refrigerant circulation passage 34 further includes a liquid return outlet 35 in the wall midway for recovering the lubricating oil 7 that is centrifugally separated back into the housing 3. The liquid return outlet 35 is directed downwards and away from the circulation direction of the refrigerant, so that the lubricating oil drops down under gravity into the reservoir 6 as indicated by the solid-line arrow in FIG. 1. In this way, the lubricating oil 7 will not be entrained in the refrigerant 30 that is discharged from the housing 3 and recirculated for the refrigeration cycle, and is quickly returned into the reservoir 6 after it has lubricated the compression mechanism 4. The refrigerant circulation passage 34 is formed by a separate component in this embodiment, but it may be formed using part of the end wall of the housing 3, or using a pipe member.

Figure 5:
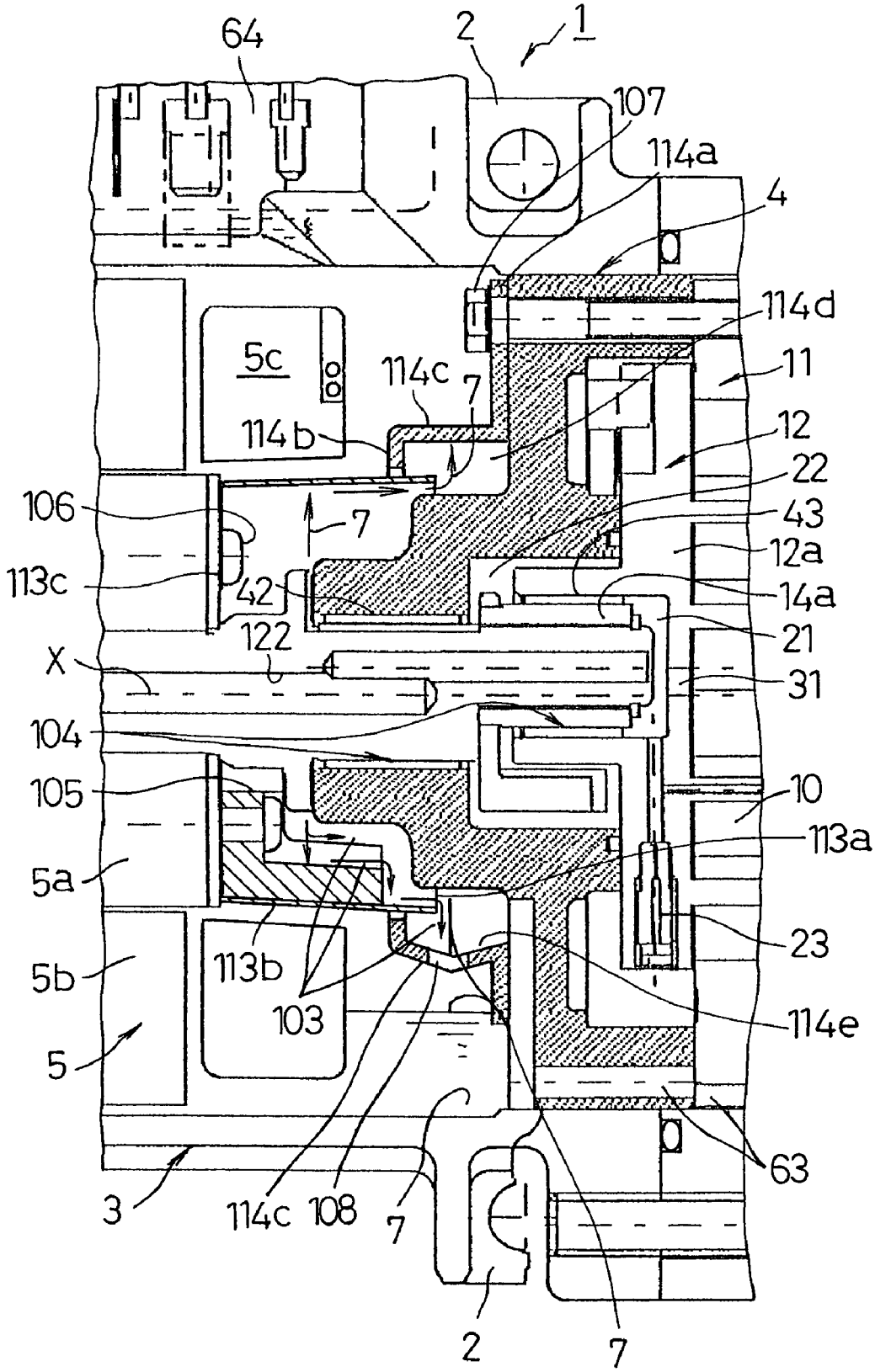
FIG. 5 is a cross-sectional view of another example of a compressor which adopts the liquid recovery method and system for the compression mechanism according to the embodiment of the invention.

In the example shown in FIG. 5, the circumferential wall 113*b* of the liquid collection member 113 has an increasing diameter in the direction of axial line X towards the outlet 113*a*. The increasing taper surface of the circumferential wall 113*b* restricts the traveling direction of the collected lubricating oil 7 that is pressed against the circumferential wall 113*b* under centrifugal force to the spreading direction along the axial line, i.e., towards the outlet 113*a*, thereby accelerating discharge and recovery of the lubricating oil 7. By appropriately setting the increasing taper angle, traveling of the lubricating oil 7 towards the opposite end from the outlet 113*a* can be prevented. In that case, one end of the circumferential wall 113*b* opposite from the outlet 113*a* need not have a structure to stop the flow of oil, and there will be more freedom of design of the liquid collection member 113 and its mounting method.

Inner face of the rotor balancer 105 that forms part of the inner face of the circumferential wall 113*b* also has an increasing tapered surface so as to accelerate the transfer of the lubricating oil 7 towards the outlet 113*a*. The outlet 113*a* need not necessarily be located at the end of the axial line X of the circumferential wall 113*b*; its position may be suitably set in accordance with its design and the relationship with the liquid return cover 114.

The spreading shape of the circumferential wall 113*b* includes a curved or stepped surface, or any other shapes which conform to surrounding components such as the shape of the electric motor's coil end 5*c*, for example. In the example shown in FIG. 5, the coil end 5*c* has an inner peripheral shape that conforms to the inclination degree of the circumferential wall 113*b*.

The liquid return cover 114 has a drain hole 108 midway along the axial line X of the cylindrical portion 114*c*, which has inclined surfaces directed downwards from both sides in the axial direction so as to form a lowermost portion 114*e*, whereby the lubricating oil 7 collected in the lowermost portion 114*e* is smoothly guided into the reservoir 6. The drain hole 108 may be located anywhere along the axial line X.

Figure 6:
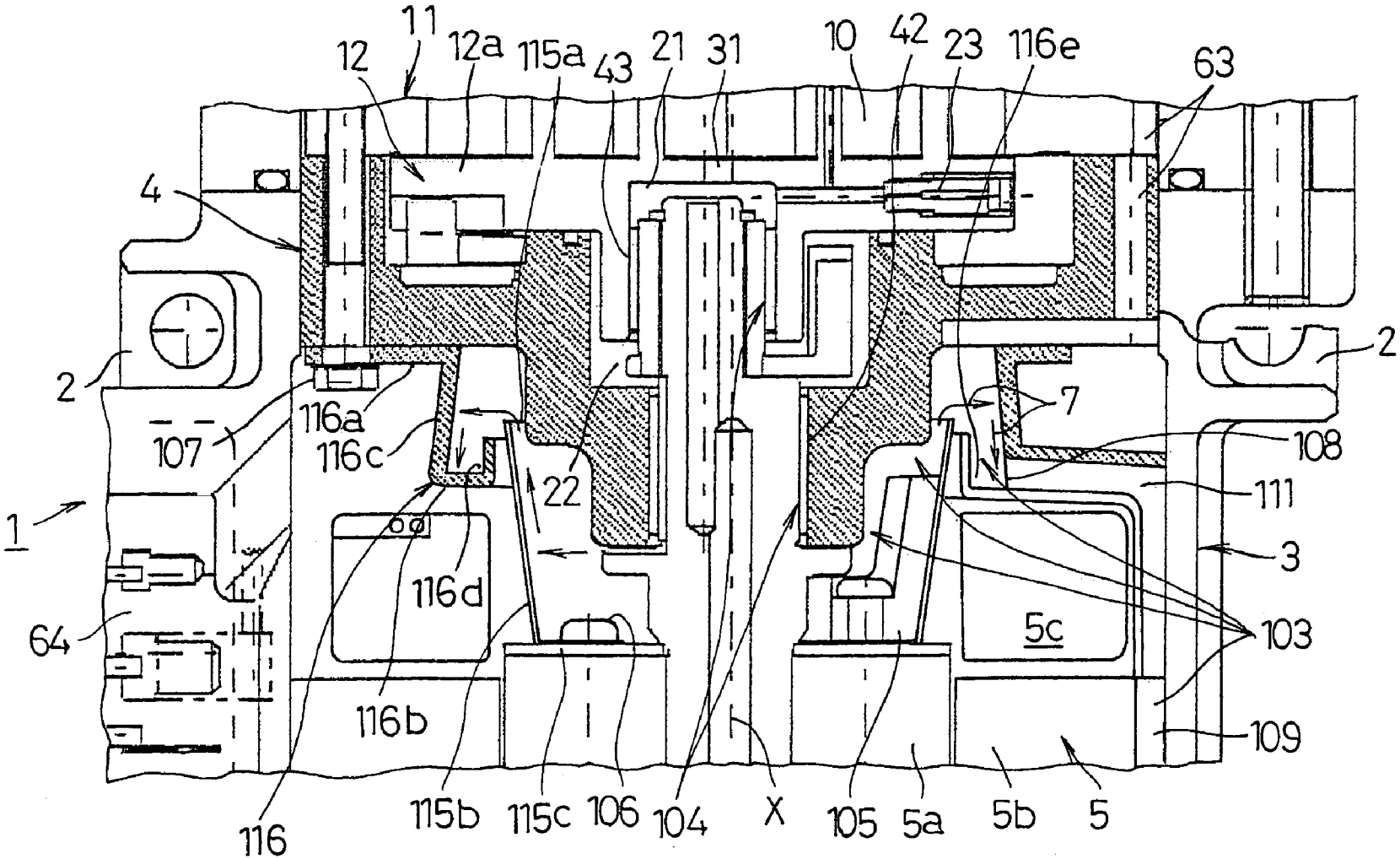
FIG. 6 is a cross-sectional view of yet another example of a compressor which adopts the liquid recovery method and system for the compression mechanism according to the embodiment of the invention.

The example shown in FIG. 6 is a vertical compressor 1. The compression mechanism 4 is located in an upper part of the housing 3, with the electric motor 5 directly below it.

The liquid collection member 115 and the liquid return cover 116 of this compressor have a different design than the other two examples.

The liquid collection member 115 is mounted on the upper end face of the rotor 5*a* of the electric motor 5, and its circumferential wall 115*b* as well as the inner face of the rotor balancer 105 have an increasing taper with a larger degree of inclination than that of the example of FIG. 5. This structure helps urge the lubricating oil 7, which is collected after being expelled from the bearing 104 and pressed against the circumferential wall 115*b* and inner face of the rotor balancer 105 under centrifugal force, upwards toward the outlet 115*a* above against gravity and outward from the outlet 115*a*.

The liquid return cover 116 is attached on the end face of the main bearing member 51 on the side of the electric motor 5 as with the other two examples. The inner edge of the inner flange 116*b* at the end of the cylindrical portion 116*c* is bent upwards to a position lower than the outlet 115*a* of the circumferential wall 115*b* so as to form an upwardly opening groove 116*d* together with the cylindrical portion 116*c*. The lubricating oil 7 centrifugally thrown out from the outlet 115*a* towards the cylindrical portion 116*c* is thus received by the groove 116*d*. The cylindrical portion 116*c* has an increasing taper from top to bottom so as to ensure that oil drops down along it without splashing. The bottom of the groove 116*d* is slanted downwards toward a lowermost portion 116*e* located on one side of the body of the housing 3 so that received oil 7 is collected in the lowermost portion 116*e* and guided into the reservoir (not shown) below from a drain hole 108. To guide the lubricating oil 7 from the drain hole 108 to the reservoir, a return passage 111 is provided, which extends from the drain hole 108 to the inner face of the body of the housing 3 and continues to an oil drop passage 109 formed between the body of the housing 3 and the stator 5*b* of the electric motor 5 down into the reservoir. The return passage 111 may be formed in various other suitable manners. In this example, it is partly formed by the wall of the housing's body for economy of parts and space.

In this example, the path 103 from the liquid collection member 115 via the liquid return cover 116 back to the reservoir 6 is longer than that of the other two examples, but nevertheless it is simpler than any of the prior art structures and short enough for quick recovery of oil.

According to the invention, as described above, lubricating liquid fed from the reservoir to the compression mechanism is discharged into the housing with or without compressed fluid after it has lubricated the compression mechanism. This exiting liquid is collected immediately by the liquid collection member, which surrounds the drive shaft and rotates with it, with its circumferential wall and the outlet at certain axial location, so that liquid does not scatter and adhere on other parts inside the housing. The collected liquid, whether it be entrained in the compressed fluid or not, travels separately from the fluid along the circumferential wall as it is pressed against the wall under centrifugal force by the rotation of the liquid collection member. As the liquid that has traveled along the circumferential wall reaches the outlet, it is centrifugally thrown outward from the outlet. The expelled liquid is received by the fixed liquid return cover that surrounds the circumferential wall near the outlet, and returned into the reservoir. Thus lubricating liquid is collected in a confined area inside the housing immediately after it has lubricated the compression mechanism and is discharged, and quickly recovered through a short path, whereby lubricant shortage caused by delayed recovery and replenishment is prevented.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A liquid recovery method for a compressor including a compression mechanism, a housing for containing the compression mechanism, and a reservoir at a lower part of the housing for holding liquid, for recovering the liquid that has been supplied to lubricate sliding parts of the compression mechanism back into the reservoir, the method comprising:

collecting the liquid, that is supplied from the reservoir to the compression mechanism, immediately after being discharged into the housing with or without compressed fluid by a circumferential wall that rotates around a drive shaft of the compression mechanism in synchronism therewith;

urging the liquid outward from the wall through an outlet formed at a predetermined axial location of the wall under centrifugal force; and receiving the liquid by a liquid return cover fixed around the outlet of the circumferential wall so as to return the liquid to the reservoir.

2. A liquid recovery method for a compressor including a compression mechanism, a housing for containing the compression mechanism, and a reservoir at a lower part of the housing for holding liquid, for recovering the liquid that has been supplied to lubricate sliding parts of the compression mechanism back into the reservoir, the method comprising:

collecting the liquid, that is supplied from the reservoir to the compression mechanism, immediately after being discharged into the housing through sliding parts that are arranged around a drive shaft and do not contribute to the compression by a circumferential wall that rotates around the drive shaft of the compression mechanism in synchronism therewith;

urging the liquid outward from the wall through an outlet formed at a predetermined axial location of the wall under centrifugal force; and receiving the liquid by a liquid return cover fixed around the outlet of the circumferential wall so as to return the liquid to the reservoir.

3. A liquid recovery system for a compressor including a compression mechanism, a housing for containing the compression mechanism, and a reservoir at a lower part of the housing for holding liquid, for recovering the liquid that has been supplied to lubricate sliding parts of the compression mechanism back into the reservoir, the system comprising:

a liquid collection member including a circumferential wall that surrounds an area into which liquid is discharged from the compression mechanism with or without compressed fluid and rotates around a drive shaft directly or indirectly therewith and an outlet at a preset axial location of the wall, the liquid collection member for collecting discharged liquid and throwing the liquid out through the outlet under centrifugal force; and a liquid return cover fixed to surround the outlet of the circumferential wall for receiving the exiting liquid and guiding the liquid back into the reservoir.

4. The liquid recovery system according to claim 3, wherein the circumferential wall is spread outward along an axial direction toward the outlet side.

5. The liquid recovery system according to claim 3, wherein the liquid collection member is located outside a rotor balancer which is either an integral or separate part.

6. The liquid recovery system according to claim 3, wherein the liquid return cover is designed so that it includes a lowermost portion from which to guide the liquid into the reservoir.

7. The liquid recovery system according to claim 6, wherein the liquid return cover is designed so that it guides the liquid from the lowermost portion via a drain hole or path into the reservoir.

8. A liquid recovery system for a compressor including a compression mechanism, a housing for containing the compression mechanism, and a reservoir at a lower part of the housing for holding liquid, for recovering the liquid that has been supplied to lubricate sliding parts of the compression mechanism back into the reservoir, the system comprising:

a liquid collection member including a circumferential wall that surrounds an area into which liquid is discharged from the compression mechanism through sliding parts that are located around a drive shaft but do not contribute to the compression, the circumferential wall being rotated around the drive shaft directly or indirectly therewith, and an outlet at a preset axial location of the wall, the liquid collection member for collecting discharged liquid and throwing the liquid out through the outlet under centrifugal force; and a liquid return cover surrounding the outlet of the circumferential wall for receiving the exiting liquid and guiding the liquid back into the reservoir.

9. A liquid recovery system for a compressor including a compression mechanism, an electric motor for driving the compression mechanism, a housing for containing the compression mechanism and the electric motor, and a reservoir at a lower part of the housing for holding liquid, for recovering the liquid that has been supplied to lubricate sliding parts of the compression mechanism back into the reservoir, the system comprising:

a liquid collection member including a circumferential wall that surrounds an area between the compression mechanism and the electric motor into which liquid is discharged through sliding parts that are located around a drive shaft but do not contribute to the compression, the circumferential wall being rotated around the drive shaft directly or indirectly therewith, and an outlet at a preset axial location of the wall, the liquid collection member for collecting discharged liquid and throwing the liquid out through the outlet under centrifugal force; and a liquid return cover surrounding the outlet of the circumferential wall for receiving the exiting liquid and guiding the liquid back into the reservoir.

10. The liquid recovery system according to claim 9, wherein an opening that the circumferential wall has at one end opposite the electric motor is doubled as the outlet.

11. A liquid recovery system for a horizontally installed compressor including a compression mechanism, an electric motor for driving the compression mechanism, a housing for containing the compression mechanism and the electric motor, and a reservoir at a lower part of the housing for holding liquid, for recovering the liquid that has been supplied to lubricate sliding parts of the compression mechanism back into the reservoir, the system comprising:

a liquid collection member including a circumferential wall that surrounds an area between the compression mechanism and the electric motor into which liquid is discharged through sliding parts that are located around a drive shaft but do not contribute to the compression, the circumferential wall being rotated around the drive shaft directly or indirectly therewith, and an outlet at a preset axial location of the wall, the liquid collection member for collecting discharged liquid and throwing the liquid out through the outlet under centrifugal force; and a liquid return cover surrounding the outlet of the circumferential wall for receiving the exiting liquid and guiding the liquid back into the reservoir.

* * * * *